US008572969B1

(12) United States Patent
Horne

(10) Patent No.: US 8,572,969 B1
(45) Date of Patent: Nov. 5, 2013

(54) METHOD FOR INCREASING THE EFFICIENCY OF A STEAM ENGINE AND APPARATUS THEREFOR

(76) Inventor: William Parrish Horne, Matthews, NC (US)

( * ) Notice: Subject to any disclaimer, the term of this patent is extended or adjusted under 35 U.S.C. 154(b) by 138 days.

(21) Appl. No.: 13/374,563

(22) Filed: Dec. 31, 2011

(51) Int. Cl.
*F01K 13/00* (2006.01)

(52) U.S. Cl.
USPC ..... 60/645; 60/670

(58) Field of Classification Search
USPC ..... 60/670, 643, 652, 317, 39.01–39.3, 775
See application file for complete search history.

(56) References Cited

U.S. PATENT DOCUMENTS 3,991,574 A * 11/1976 Frazier ..... 60/645
4,395,885 A * 8/1983 Cozby ..... 60/669
7,650,933 B2 * 1/2010 Gilbert et al. ..... 165/159

* cited by examiner

*Primary Examiner* — Thomas Denion
*Assistant Examiner* — Kelsey Stanek
(74) *Attorney, Agent, or Firm* — Ted Masters

(57) ABSTRACT

A steam engine receives steam from a boiler which is heated by hot gas produced by a burner. The flue gas from the boiler is used to heat the body of the steam engine. The body of the steam engine has a plurality of passages which are shaped and dimensioned to receive and pass the flue gas, so that the flue gas heats the body, and thereby increases the power and efficiency of the steam engine.

20 Claims, 8 Drawing Sheets

METHOD FOR INCREASING THE EFFICIENCY OF A STEAM ENGINE AND APPARATUS THEREFOR

CROSS REFERENCE TO RELATED APPLICATION

None

TECHNICAL FIELD

The present invention pertains generally to steam engines, and more particularly to a method and apparatus for increasing the efficiency of a reciprocating steam engine.

BACKGROUND OF THE INVENTION

Steam engines are well known in the art. For these engines a burner heats a boiler containing water. The water is evaporated into water vapor and thence into steam. The steam is routed to an engine where the steam expands thereby producing mechanical energy. In a reciprocating steam engine the steam drives a piston which is connected to a drive shaft in a manner similar to an internal combustion engine. The expanded steam is exhausted from the engine, condensed into water and routed back to the boiler for reuse. It is known in the art that the power and efficiency of a steam engine increases as the temperature of the engine increases.

BRIEF SUMMARY OF THE INVENTION

The present invention is directed to a method and apparatus for increasing the efficiency of a steam engine. The method and apparatus employ the flue gas (including hot gases and other combustion products) from the boiler/burner (normally wasted) to heat the steam engine. The flue gas is routed via a conduit from the boiler to the steam engine, where it flows around and heats the cylinders of the steam engine. A jacket of insulation may be disposed around the steam engine to retain heat and conserve energy.

In accordance with an embodiment, a steam engine receives steam from a boiler which is heated by a burner which produces flue gas. The steam engine includes a body which has a plurality of passages which are shaped and dimensioned to receive and pass the flue gas, so that the flue gas heats the body.

In accordance with another embodiment, the body has a first side and an opposite second side. The flue gas passes through the plurality of passages from the first side of the body to the second side of the body.

In accordance with another embodiment, a baffle is disposed between a flue gas intake portal and the body. The flue gas passes through the baffle before being received and passed by the plurality of passages.

In accordance with another embodiment, the baffle includes a rectangular sheet which has a plurality of apertures for passing the flue gas.

In accordance with another embodiment, insulation is disposed around the body to retain the heat provided by the flue gas.

In accordance with another embodiment, the body includes a plurality of cylinders. The plurality of passages are arranged so that the flue gas is passed around the plurality of cylinders.

In accordance with another embodiment, the plurality of cylinders are disposed in parallel side-by-side spaced apart relationship. The plurality of passages include a slot disposed between adjacent said cylinders, the slot being parallel to the cylinders.

In accordance with another embodiment, the body includes a crankcase. A pressure relief valve is connected to the crankcase. The pressure relief valve opens when pressure in the crankcase exceeds a predetermined pressure.

In accordance with another embodiment, the steam engine has a flue gas exhaust portal. An exhauster is connected to the flue gas exhaust portal, the exhauster pulls the flue gas from the steam engine.

In accordance with another embodiment, the steam engine is part of a steam engine system, wherein the flue gas exists the boiler through a flue gas exhaust portal. The steam engine has a flue gas intake portal. A conduit is connected between the flue gas exhaust portal and the flue gas intake portal.

Other embodiments, in addition to the embodiments enumerated above, will become apparent from the following detailed description, taken in conjunction with the accompanying drawings, which illustrate, by way of example, the principles of the method and apparatus.

DETAILED DESCRIPTION OF THE INVENTION

Figure 1:
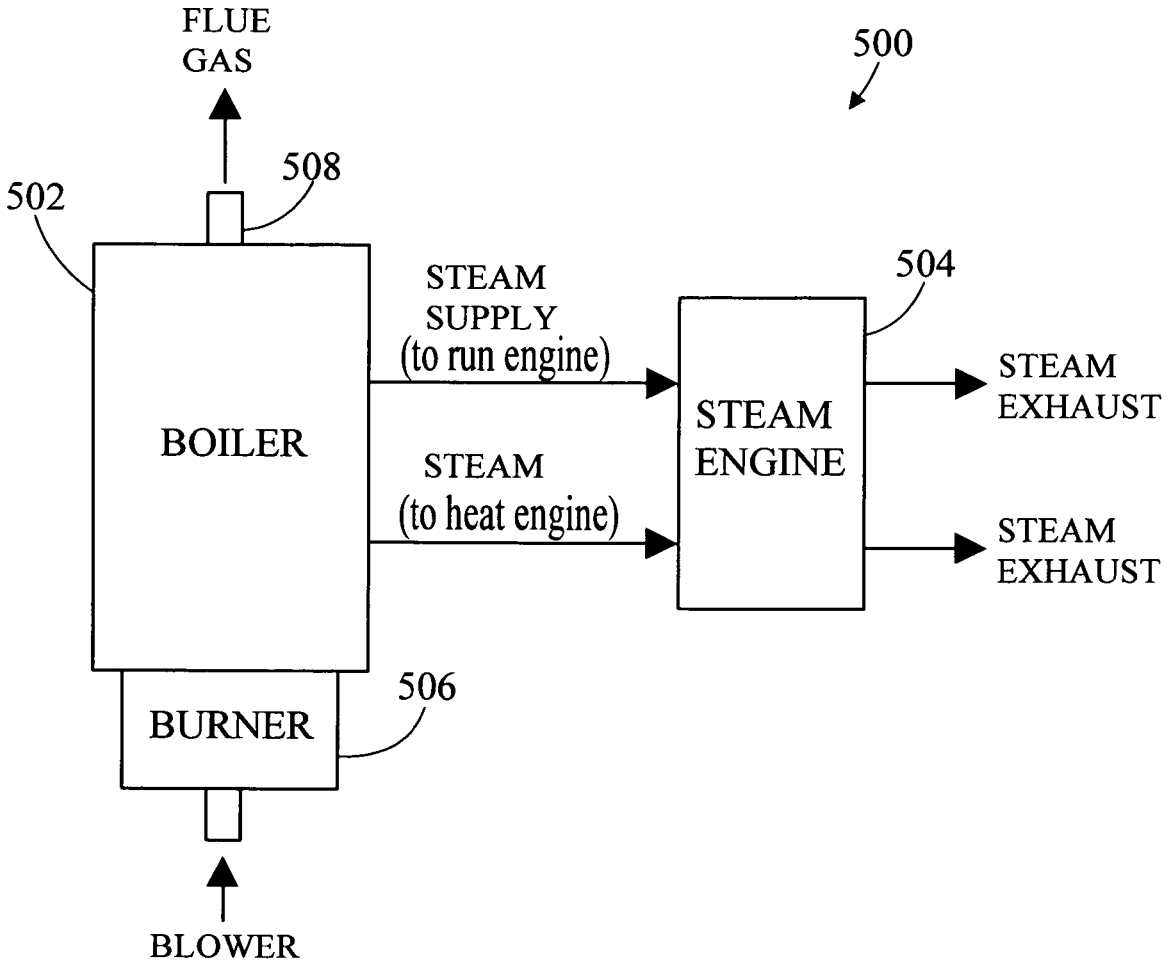
Fig. 1 PRIOR ART
FIG. 1 is a block diagram of a prior art steam engine system.
Figure 2:
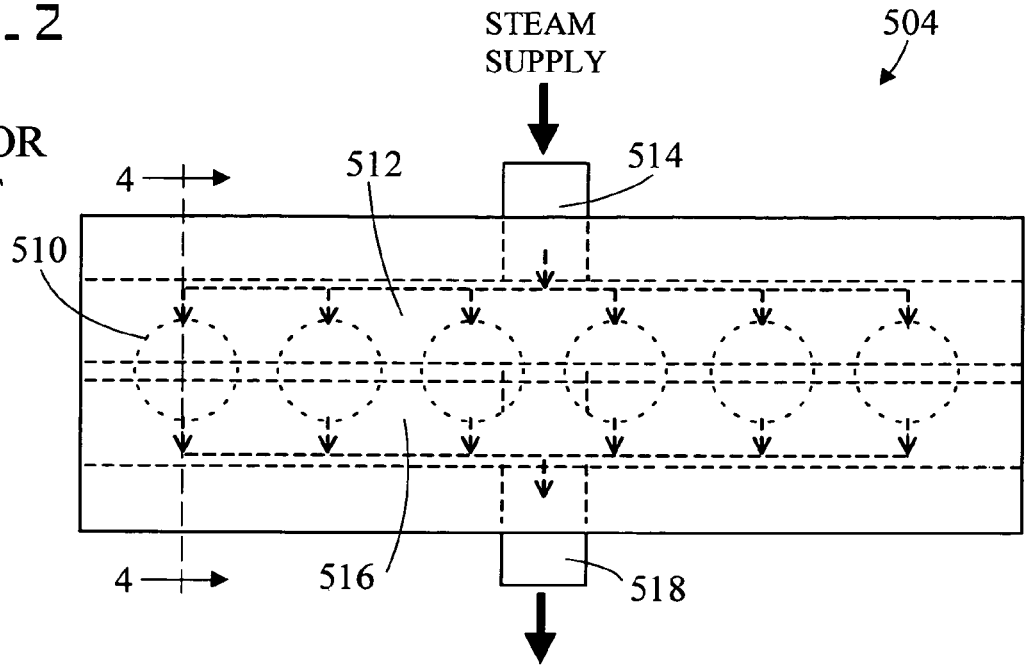
Fig. 2 PRIOR ART
FIG. 2 is a top plan view of a prior art steam engine.
Figure 3:
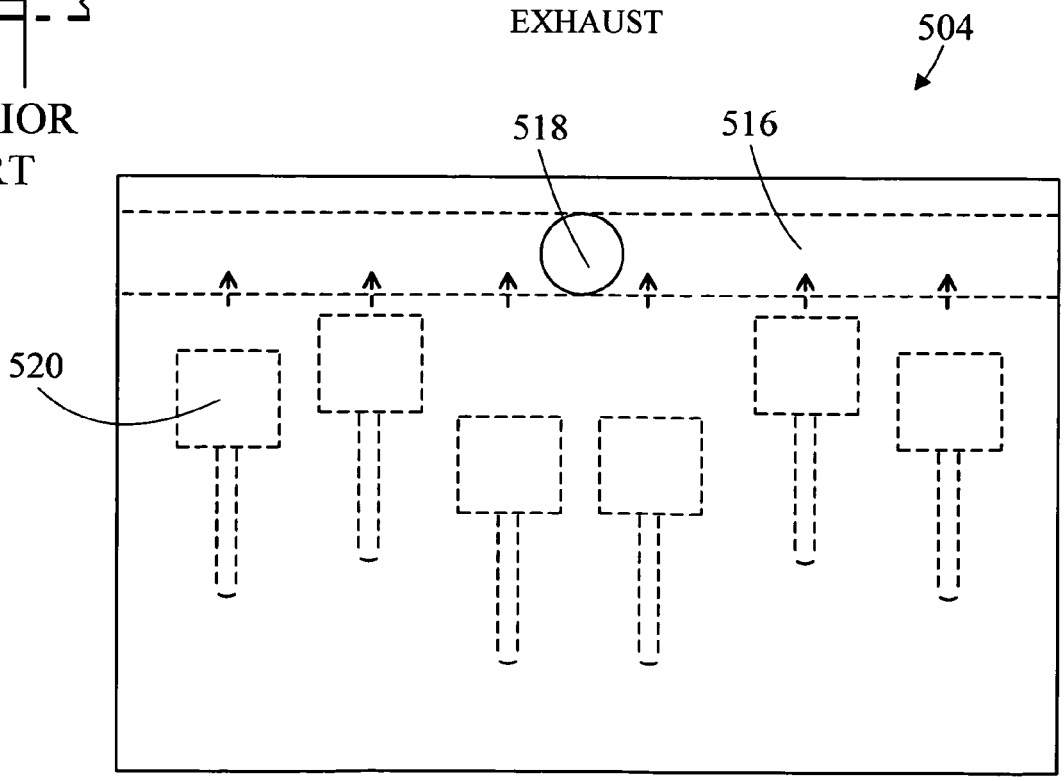
Fig. 3 PRIOR ART
FIG. 3 is a side elevation view of the prior art steam engine.
Figure 4:
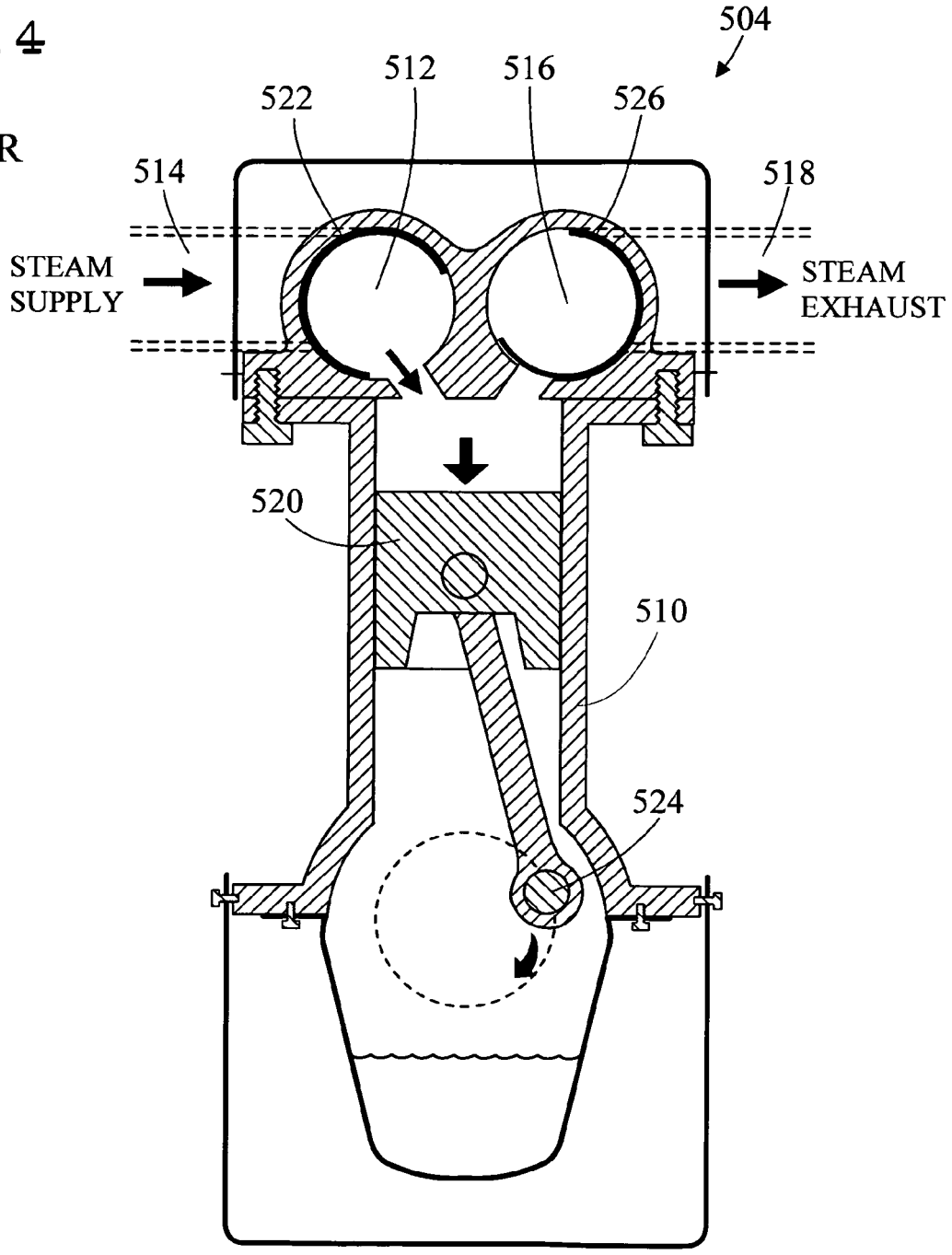
Fig. 4 PRIOR ART
FIG. 4 is an enlarged cross sectional view along the line 4-4 of FIG. 2.

Referring initially to FIG. 1, there is illustrated a block diagram of a prior art steam engine system, generally designated as 500. Steam engine system 500 includes a boiler 502 which produces steam which is routed as a steam supply to a steam engine 504. The exhaust steam from steam engine 504 is typically condensed back to water and returned to boiler 502 for reuse. A burner 506 which produces hot gas heats boiler 502, and the hot gas exits boiler 502 as flue gas through a flue gas exhaust portal 508 (also referred to herein as a flue gas outlet), and enters the atmosphere. In the shown prior art steam engine system 500, steam engine 504 is a reciprocating steam engine as is depicted in FIGS. 2-4. In some steam engine systems 500 a portion of the steam produced by boiler 502 is used to heat the block of steam engine 504, by circulating the steam around the cylinders of steam engine 504. This additional heat improves the efficiency of the steam engine system 500. Also, in some steam engine systems 500, a blower is used to pressurize boiler 502 so that the flue gas is forced out of boiler 502 under positive pressure.

FIGS. 2 and 3 are top plan and side elevation views respectively of prior art steam engine 504, and FIG. 4 is an enlarged cross sectional view along the line 4-4 of FIG. 2. As shown steam engine 504 is a reciprocating engine having six in-line cylinders 510. The steam supply from boiler 502 (refer to FIG. 1) enters a steam intake manifold 512 via a steam input portal 514 and is distributed to each cylinder 510. The exhaust steam from cylinders 510 enters a steam exhaust manifold 516, and exits steam engine 504 through a steam exhaust portal 518. The steam supply operates pistons 520 in the conventional reciprocating manner. FIG. 4 shows the steam supply entering steam intake manifold. A rotary valve 522 controls the entry of steam into cylinders 510. Pistons 520 are connected to a crankshaft 524 in the conventional manner. Similarly a rotary valve 526 controls the exhaust of the steam.

Figure 5:
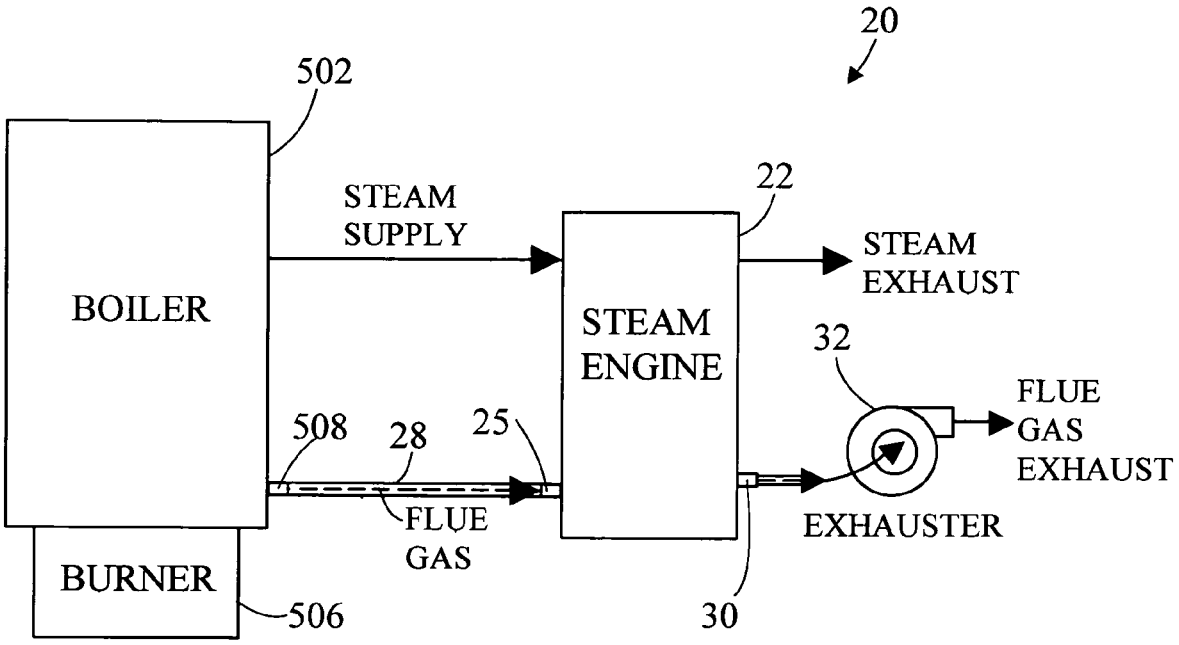
FIG. 5 is a block diagram of a steam engine system in accordance with the present invention.
Figure 6:
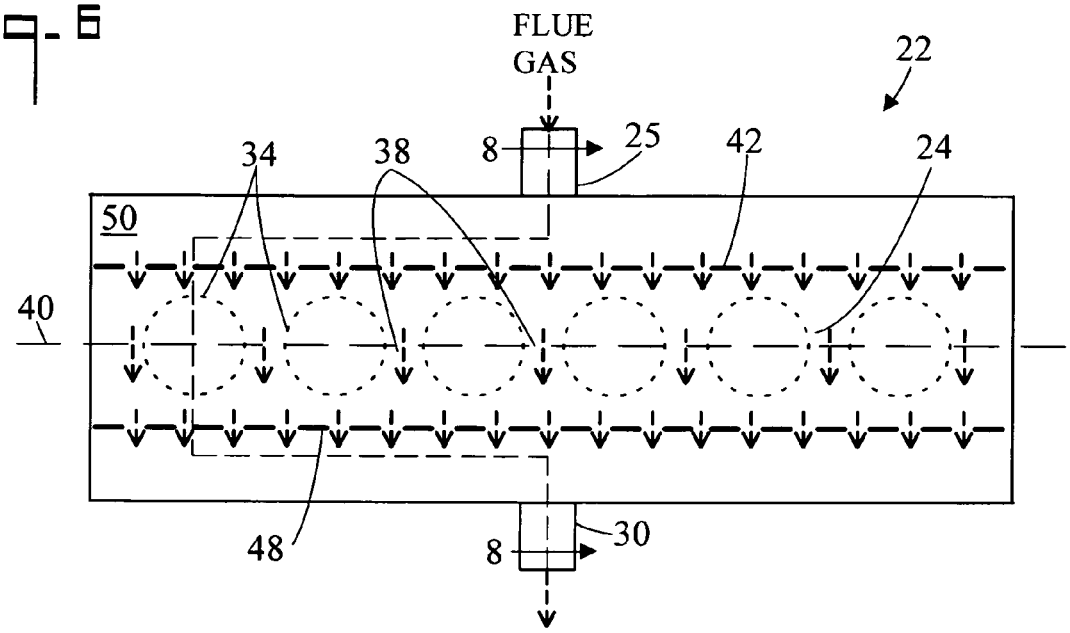
FIG. 6 is a top plan view of a steam engine.
Figure 7:
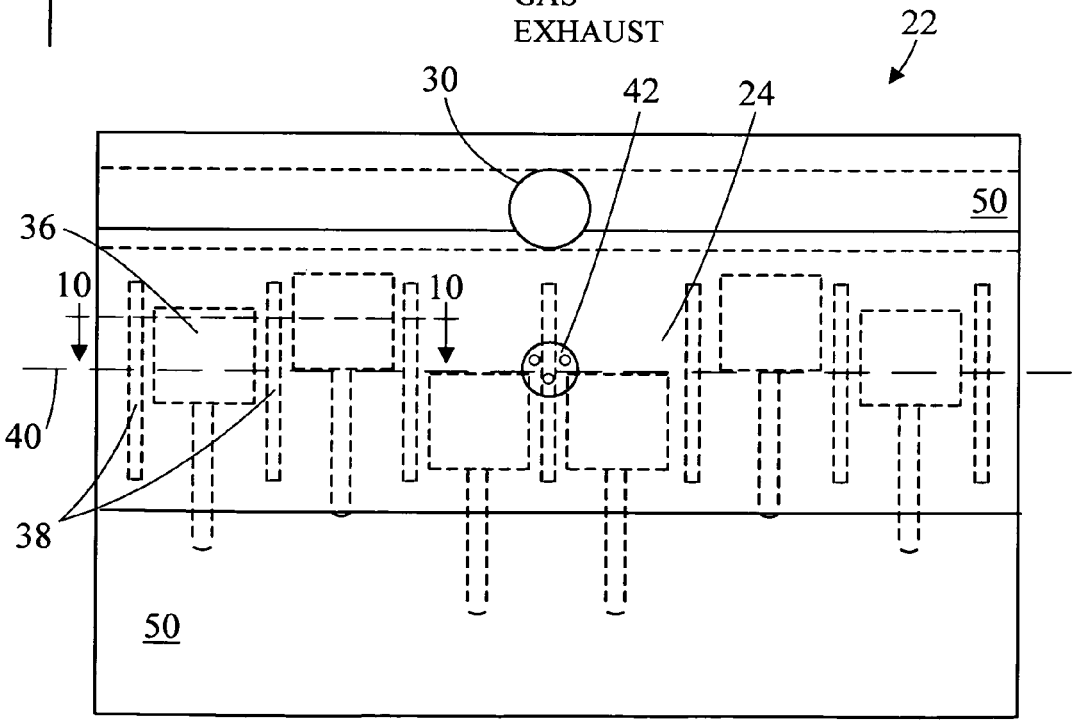
FIG. 7 is a side elevation view of the steam engine.
Figure 8:
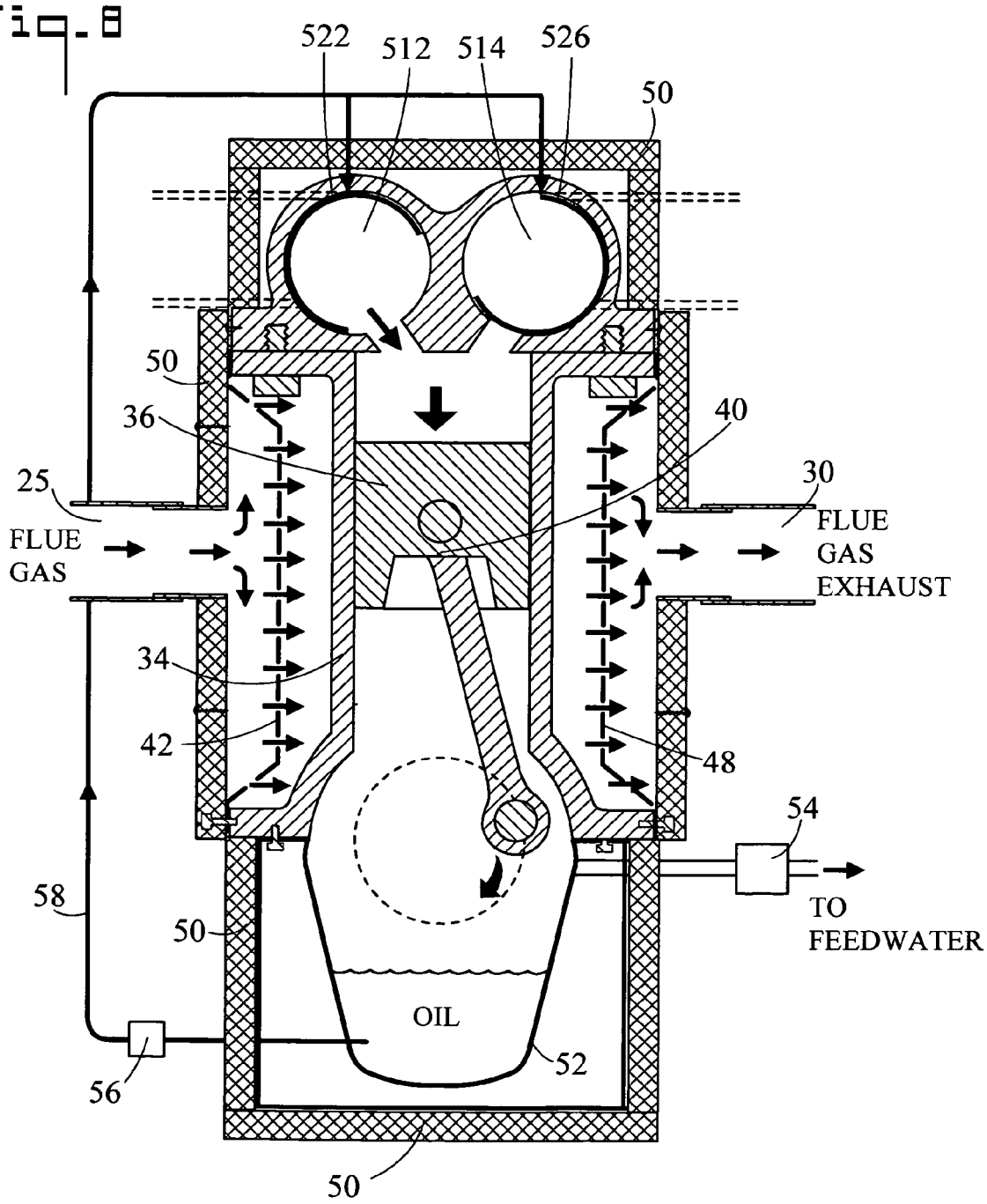
FIG. 8 is an enlarged cross sectional view along the line 8-8 of FIG. 6.

Now referring to FIG. 5, there is illustrated a block diagram of a steam engine system in accordance with the present invention, generally designated as 20. As with prior art steam engine system 500, in steam engine system 20 burner 506 produces hot gas which heats boiler 502, the hot gas exiting boiler 502 as flue gas through a flue gas exhaust portal 508. However, in steam engine system 20 the flue gas is not exhausted into the atmosphere, but rather is routed to steam engine 22. Steam engine 22 has a body 24 and a flue gas intake portal 25 (also referred to herein as a flue gas inlet). A conduit 28 (such as a pipe) is connected between flue gas exhaust portal 508 and flue gas intake portal 25, where the flue gas is directed toward and heats body 24. As used herein the term "body" means the main portion of steam engine 22 which includes the cylinders and pistons as is depicted in FIGS. 6-8. The body is sometimes called the "block" of the engine. In the shown embodiment, steam engine 22 has a flue gas exhaust portal 30. An exhauster 32 is connected to flue gas exhaust portal 30, and pulls the used flue gas from steam engine 22. Exhauster 32 can be used separately or in conjunction with the pressurization blower discussed under in FIG. 1 above.

FIGS. 6 and 7 are top plan and side elevation views respectively of steam engine 22, and FIG. 8 is an enlarged cross sectional view along the line 8-8 of FIG. 6. Body 24 includes a plurality of cylinders 34 which in the shown embodiment are disposed in parallel side-by-side spaced apart relationship (also refer to FIGS. 10 and 11). A corresponding plurality of pistons 36 are disposed within the plurality of cylinders 34. Body 24 has a plurality of passages 38 which are shaped and dimensioned to receive and pass the flue gas. The plurality of passages 38 are arranged so that the flue gas is passed around and heats the plurality of cylinders 34, thereby increasing the efficiency of steam engine 22. In the shown embodiment, the plurality of passages 38 include a vertical slot disposed between adjacent cylinders 34 and parallel to cylinders 34. In the shown embodiment, body 24 has a first side (shown on the top in FIG. 6) and an opposite second side (shown on the bottom in FIG. 6). Flue gas passes through the plurality of passages 38 from the first side of body 24 to the second side of body 24 (refer also to FIG. 8). It may be appreciated however, the flue gas could be passed around cylinders 34 in other ways. (refer to FIG. 12 and the associated discussion). The plurality of cylinders 34 has a longitudinal centerline 40 which passes generally through the center of body 24. Flue gas intake portal 25 is disposed near longitudinal centerline 40 of cylinders 34. That is, in order to more evenly heat steam engine 22, the flue gas is directed at the longitudinal and vertical center of body 24. It is noted that in FIG. 6, the steam supply and steam exhaust have been omitted for clarity.

Steam engine 22 further includes a baffle 42 which is disposed between flue gas intake portal 25 and body 24. The flue gas passes through baffle 42 before being received and passed by the plurality of passages 38. The purpose of baffle 42 is to evenly distribute the flue gas to all of the cylinders 34. In the shown embodiment, baffle 42 includes a rectangular sheet 44 which has a plurality of apertures 46 for passing the flue gas (refer also to FIG. 9). Also in the shown embodiment, a second baffle 48 is disposed on the opposite side of body 24 (i.e on the side where the flue gas is exhausted). Second baffle 48 also aids in evenly distributing the flue gas to all cylinders 34.

Steam engine 22 further includes insulation 50 which is disposed around body 24 to retain the heat provided by the flue gas. In the shown embodiment insulation comprises a jacket which surrounds steam engine 22, the jacket being fabricated from insulation having a protective metal exterior.

Referring specifically to FIG. 8, body 24 includes a crankcase 52. A pressure relief valve 54 is connected to crankcase 52. Pressure relief valve 54 opens when pressure in crankcase 52 exceeds a predetermined pressure (e.g. 5 psi). Pressure relief valve 54 prevents excessive pressure from building up in crankcase 52 and thereby reducing the efficiency of steam engine 22 by applying back pressure to pistons 36. The excessive pressure in the crankcase can be caused by steam blowing by the piston and into the crankcase. Also in an embodiment, a pump 56 and line 58 route oil from crankcase 52 to steam intake manifold 512 and steam exhaust manifold 514 to lubricate rotary valves 522 and 526.

Figure 9:
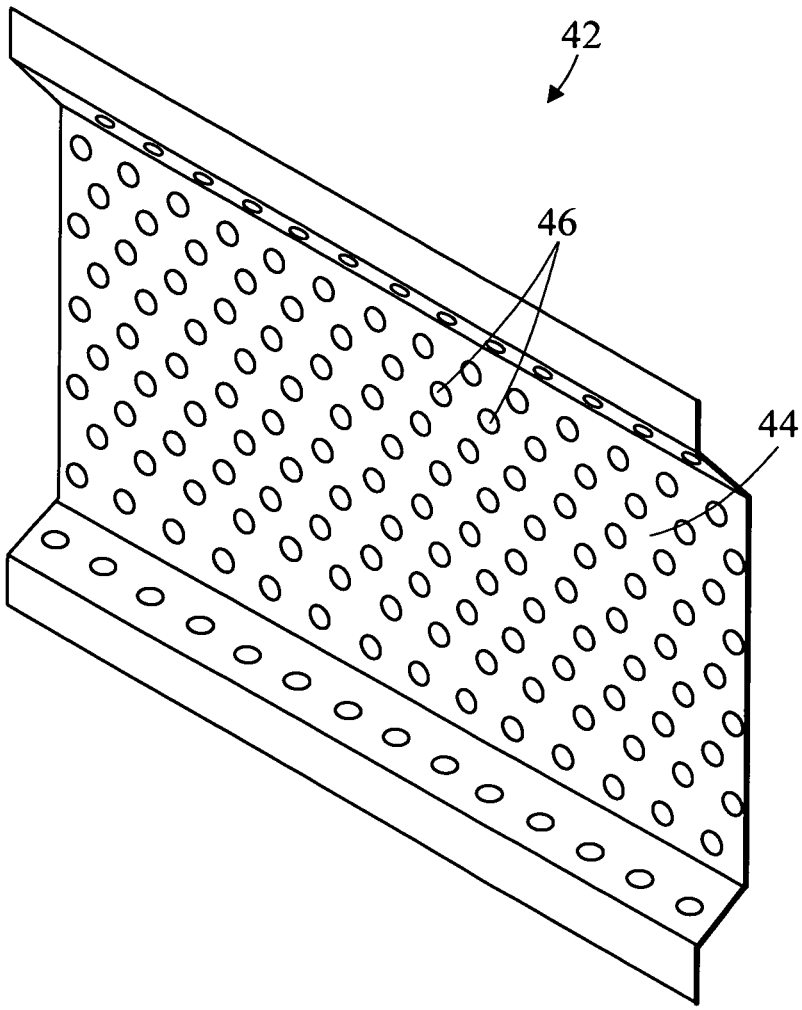
FIG. 9 is an enlarged perspective view of a baffle.

FIG. 9 is an enlarged perspective view of a baffle 42 showing rectangular sheet 44 and apertures 46.

Figure 10:
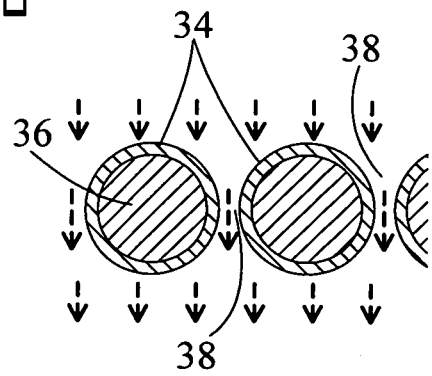
FIG. 10 is a cross sectional view along the line 10-10 of FIG. 7.

FIG. 10 is a cross sectional view along the line 10-10 of FIG. 7 showing flue gas flowing through passages 38 and around cylinders 34.

Figure 11:
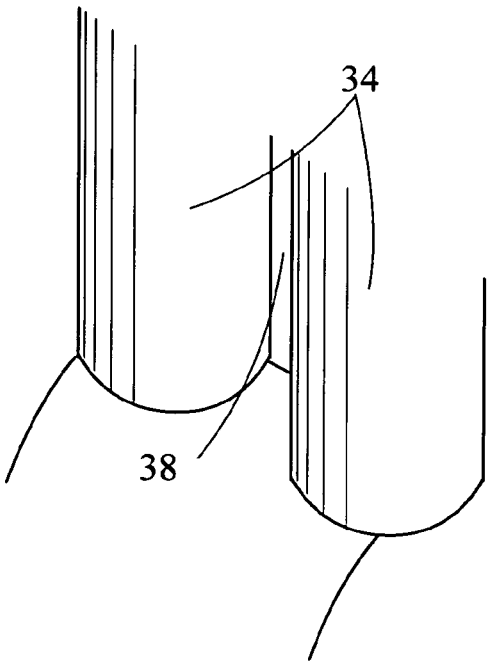
FIG. 11 is an enlarged perspective view of two cylinders.

FIG. 11 is an enlarged perspective view of two cylinders 34 and a passage 38 therebetween.

Figure 12:
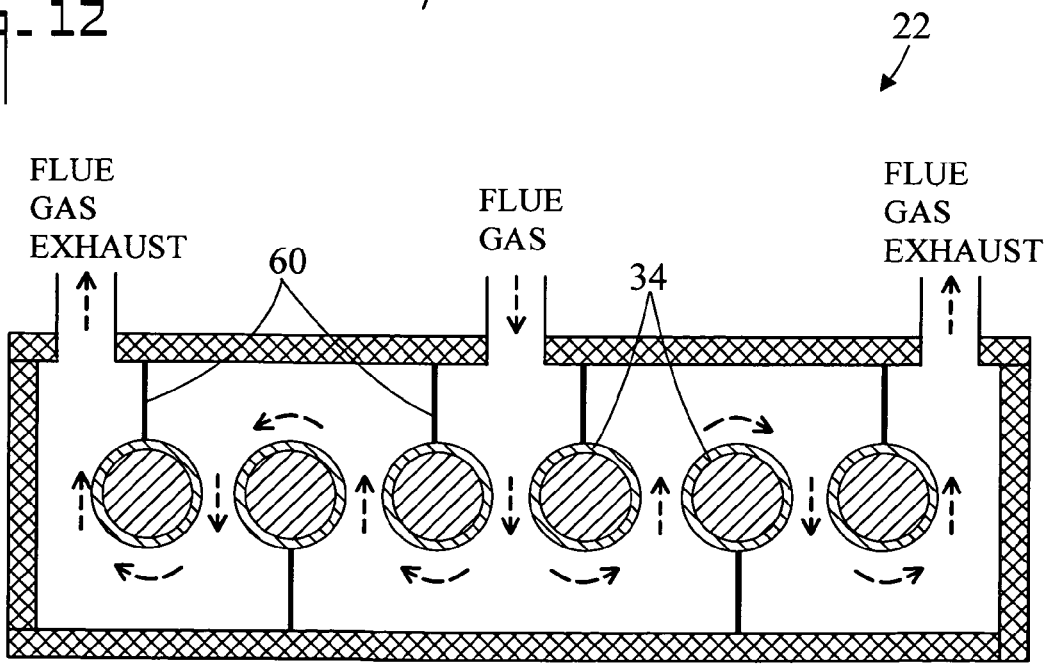
FIG. 12 is a cross sectional view of an alternate flue gas path.

FIG. 12 is a cross sectional view of an alternate flue gas path. In this embodiment, the flue gas enters through one portal and is forced to flow around all of the cylinders 34. Barriers 60 direct the flow path of the flue gas. If may be appreciated however, that other arrangements could also be employed to route the flue gas around cylinders 34.

In terms of use, a method for increasing the efficiency of a steam engine 22 includes: (refer to FIGS. 1-12)

(a) providing a boiler 502 which produces steam;

(b) providing a burner 506 which produces hot gas which heats boiler 502, the hot gas exiting boiler 502 as flue gas through a flue gas exhaust portal 508;

(c) providing a steam engine 22 having a body 24 and a flue gas intake portal 25;

(d) providing a conduit 28 connected between flue gas exhaust portal 508 and flue gas intake portal 25; and, (e) passing flue gas through conduit 28 so that the flue gas is directed toward and heats body 24 of steam engine 22.

The method further including:

in (c), steam engine 22 including a baffle 42 which is disposed between flue gas intake portal 25 and body 24; and, in (e), the flue gas passing through baffle 42 before heating body 24.

The method further including:

in (c), baffle 42 including a rectangular sheet 44 having a plurality of apertures 46 for passing the flue gas in (e).

The method further including:

in (c), body 24 having a plurality of passages 38 which are shaped and dimensioned to receive and pass the flue gas; and, in (e), the plurality of passages 38 receiving and passing the flue gas.

The method further including:

in (c), body 24 having a first side and an opposite second side; and, in (e), the flue gas passing through the plurality of passages 38 from the first side of body 24 to the second side of body 34.

The method further including:

in (c), body 24 including a plurality of cylinders 34; and, in (c), the plurality of passages 38 arranged so that in (e) the flue gas is passed around the plurality of cylinders 34.

The method further including:

in (c), the plurality of cylinders 34 disposed in parallel side-by-side spaced apart relationship; and, in (c), in the plurality of passages including a slot disposed between adjacent cylinders 34, the slot being parallel to cylinders 34.

The method further including:

in (c), providing insulation disposed around body 34 to retain the heat provided by the flue gas in (e).

The method further including:

in (c), body 34 including a crankcase 52;

in (c), providing a pressure relief valve 54 connected to crankcase 52; and, pressure relief valve 54 opening when pressure in crankcase 52 exceeds a predetermined pressure.

The method further including:

in (c), steam engine 22 having a flue gas exhaust portal 30;

an exhauster 32 connected to flue gas exhaust portal 30; and, in (e), exhauster 32 pulling flue gas from steam engine 22.

The embodiments of the method and apparatus described herein are exemplary and numerous modifications, combinations, variations, and rearrangements can be readily envisioned to achieve an equivalent result, all of which are intended to be embraced within the scope of the appended claims. Further, nothing in the above-provided discussions of the method and apparatus should be construed as limiting the invention to a particular embodiment or combination of embodiments. The scope of the invention is best defined by the appended claims.

I claim:

1. A method for increasing the efficiency of a steam engine, comprising;

(a) providing a boiler which produces steam;

(b) providing a burner which produces hot gas which heats said boiler, said hot gas exiting said boiler as flue gas through a flue gas outlet;

(c) providing a steam engine having a body and a flue gas inlet;

(d) providing a conduit connected between said flue gas outlet and said flue gas inlet; and, (e) passing said flue gas through said conduit so that said flue gas is directed toward and heats said body of said steam engine.

2. The method of claim 1, further including:

in (c), said steam engine including a baffle disposed between said flue gas inlet and said body; and, in (e), said flue gas passed by said baffle before heating said body.

3. The method of claim 2, further including:

in (c), said baffle including a rectangular sheet having a plurality of apertures for passing said flue gas in (e).

4. The method of claim 1, further including:

in (c), said body having a plurality of passages which are shaped and dimensioned to receive and pass said flue gas; and, in (e), said plurality of passages receiving and passing said flue gas.

5. The method of claim 4, further including:

in (c), said body having a first side and an opposite second side; and, in (e), said flue gas passing through said plurality of passages from said first side of said body to said second side of said body.

6. The method of claim 4, further including:

in (c), said body including a plurality of cylinders; and, in (c), said plurality of passages arranged so that in (e) said flue gas is passed around said plurality of cylinders.

7. The method of claim 6, further including:

in (c), said plurality of cylinders disposed in parallel side-by-side spaced apart relationship; and, in (c), in said plurality of passages including a slot disposed between adjacent said cylinders, said slot being parallel to said cylinders.

8. The method of claim 1, further including:

in (c), providing insulation disposed around said body to retain the heat provided by said flue gas in (e).

9. The method of claim 1, further including:

in (c), said body including a crankcase;

in (c), providing a pressure relief valve connected to said crankcase; and, said pressure relief valve opening when pressure in said crankcase exceeds a predetermined pressure.

10. The method of claim 1, further including:

in (c), said steam engine having a flue gas exhaust portal;

an exhauster connected to said flue gas exhaust portal; and, in (e), said exhauster pulling said flue gas from said steam engine.

11. A steam engine system, comprising:

a boiler which produces steam;

a burner which produces hot gas which heats said boiler, said hot gas exiting said boiler as flue gas through a flue gas outlet;

a steam engine having a body and a flue gas inlet; and, a conduit connected between said flue gas outlet and said flue gas inlet.

12. The steam engine system according to claim 11, further including:

said body having a plurality of passages which are shaped and dimensioned to receive and pass said flue gas.

13. The steam engine system according to claim 12, further including:

said body having a first side and an opposite second side; and, said flue gas passing through said plurality of passages from said first side of said body to said second side of said body.

14. The steam engine system according to claim 12, further including:

a baffle disposed between said flue gas inlet and said body; and, said flue gas passed by said baffle before being received and passed by said plurality of passages.

15. The steam engine system according to claim 14, further including:

said baffle including a rectangular sheet having a plurality of apertures for passing said flue gas.

16. The steam engine system according to claim 12, further including:

said body including a plurality of cylinders; and, said plurality of passages arranged so that said flue gas is passed around said plurality of cylinders.

17. The steam engine system according to claim 16, further including:

said plurality of cylinders disposed in parallel side-by-side spaced apart relationship; and, said plurality of passages including a slot disposed between adjacent said cylinders, said slot being parallel to said cylinders.

18. The steam engine system according to claim 11, further including:

insulation disposed around said body to retain the heat provided by said flue gas.

19. The steam engine system according to claim 11, further including:

said body including a crankcase;

a pressure relief valve connected to said crankcase; and, said pressure relief valve opening when pressure in said crankcase exceeds a predetermined pressure.

20. The steam engine system according to claim 11, further including:

said steam engine having a flue gas exhaust portal;

an exhauster connected to said flue gas exhaust portal and, said exhauster pulling the flue gas from said steam engine.

* * * * *